United States Patent [19]

Hasegawa et al.

[11] Patent Number: 4,505,605

[45] Date of Patent: Mar. 19, 1985

[54] RIBBON CARTRIDGE

[75] Inventors: Yuzo Hasegawa; Naokazu Shimoda, both of Nagoya, Japan

[73] Assignee: Brother Kogyo Kabushiki Kaisha, Nagoya, Japan

[21] Appl. No.: 546,280

[22] Filed: Oct. 28, 1983

[30] Foreign Application Priority Data

Nov. 20, 1982 [JP] Japan ..... 57-175694[U]

[51] Int. Cl.[3] ..... B41J 35/28

[52] U.S. Cl. ..... 400/208; 400/234

[58] Field of Search ..... 400/207, 208, 208.1, 400/234, 617, 618; 242/199, 75.45, 75.43, 75.4, 155 R

[56] References Cited

U.S. PATENT DOCUMENTS 4,010,839 3/1977 Guerrini et al. ..... 400/207
4,058,197 11/1977 West ..... 242/75.4 X

FOREIGN PATENT DOCUMENTS 1010285 6/1957 Fed. Rep. of Germany ..... 400/208
3027737 2/1981 Fed. Rep. of Germany ... 400/208.1

*Primary Examiner*—Edgar S. Burr
*Assistant Examiner*—Charles A. Pearson
*Attorney, Agent, or Firm*—Moonray Kojima

[57] ABSTRACT

A ribbon cartridge wherein a supply spool is continually biased so that the outer circumference of the ribbon wound thereon, is continually pressed against the inside wall surface of a case and wherein the inside wall surface has part thereof of a rough surface and of varying frictional resistance.

9 Claims, 3 Drawing Figures

RIBBON CARTRIDGE

BACKGROUND OF THE INVENTION

1. Field of the Invention

This invention relates to ribbon cartridges, such as used in typewriters, printers and the like.

2. Description of Prior Art

Prior cartridges of the type described comprise a ribbon wound on a supply spool which is wound up on a take up spool which is rotated by a driving roller according to desired printing operation. The take up spool, of such known ribbon cartridges, is adapted to be driven by the driving roller so that the take up spool will wind the ribbon by a fixed length during each printing operation. However, disadvantageously, the ribbon is often loosened or excessively tightened between the supply spool and the take up spool due to variations in tension applied to the ribbon. Thus, it is difficult to wind the ribbon by a precise predetermined length during each printing operation.

According to a known method of stabilizing the tension of the ribbon supplied by a supply spool, the ribbon, wound on the supply spool, is pressed against the inside wall surface of the cartridge by a spring member, to apply frictional resistance of the wall surface of the ribbon. This method, however, is unsatisfactory because it is difficult to apply an appropriate frictional resistance at all times to the ribbon.

Thus, with prior art devices, it is difficult to attain reliable, constant and precise amount of tension at all times.

SUMMARY OF THE INVENTION

Accordingly, an object of the invention is to overcome the foregoing and other disadvantages and deficiencies of the prior art.

Another object is to provide a ribbon cartridge of simple construction which is capable of applying an appropriate frictional resistance to the ribbon at all times and thus maintain a predetermined tension on the ribbon at all times.

A further object is to provide a ribbon cartridge capable of continually maintaining a predetermined tension on the ribbon even if the biasing force of a spring member used for pressing the ribbon against the inside wall surface of the casing changes due to the reduction in diameter of the ribbon wound on the supply spool.

The foregoing and other objects are attained by the invention which encompasses a ribbon cartridge comprising a case, a supply spool disposed in the case for carrying a supply of wound up ribbon; a take up spool disposed in the case for winding up the ribbon supplied by the supply spool; a spring member for biasing the supply spool so that the ribbon wound thereon is pressed continually against the inside wall surface of the case; wherein the inside wall surface has an irregular, rough surface in the area whereat the ribbon is in contact with the inside case surface and the rough surface is of varying frictional resistance.

DETAILED DESCRIPTION OF PREFERRED EMBODIMENTS

Figure 1:
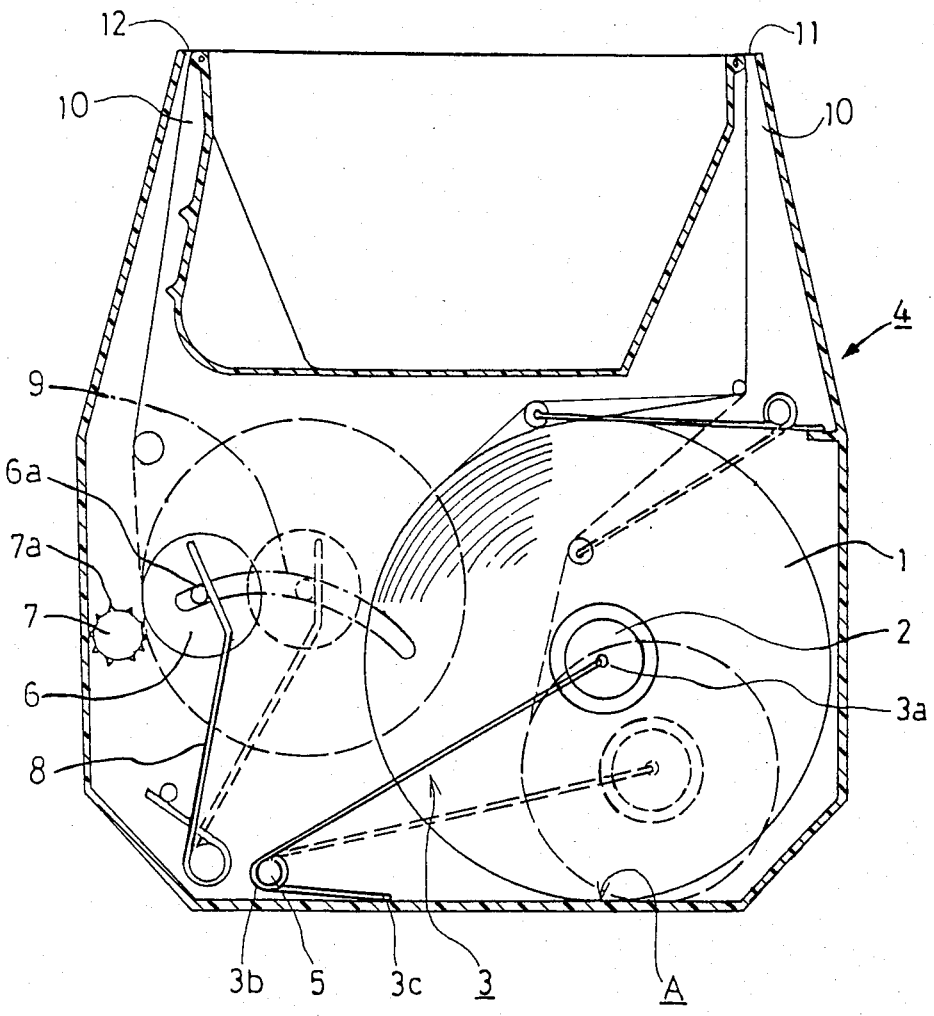
FIG. 1 is a plan view of an illustrative embodiment of the invention.

Referring to FIG. 1, there is depicted a cartridge comprising a lower case 4 containing supply spool 2, take up spool 6, drive roller 7 and springs 3 and 8. The upper case is removed to show the contents of the cartridge, and to simplify the description. Guide hole or channel 9 is representationally depicted as though the upper case were present, and is so to be understood.

In FIG. 1, torsion spring 3 is depicted having one end **3*a* fitted in a hole formed at the center of a supply spool 2, carrying a supply of a ribbon 1 wound thereon, to support supply spool 2 rotatively; a coiled part 3*b* fit around a pin 5 fixedly provided on lower case 4 and another end 3*c* attached to or placed against the inside wall surface of lower case 4. Thus, spring 3 biases supply spool 2, rotatably supported by end 3*a*, continually in a clockwise direction so that ribbon 1 wound on supply spool 2, is kept in continual contact with the inside surface wall A of lower case 4**.

A takeup spool 6 for taking up ribbon 1 after use, is rotated by a driving roller 7, connected to a driving shaft of a motor, not shown, and provided with a plurality of teeth **7*a* along the circumference thereof. A torsion spring 8 engaging a center stud 6*a* of takeup spool 6, biases takeup spool 6 continually in a counterclockwise direction so that takeup spool 6 is pressed continually against drive roller 7 and the driving power of drive roller 7 is transmitted reliably to take up spool 6. A guide slot 9 is formed in the upper case, not shown, to guide the center stud 6*a* of spool 6, as spool 6 moves clockwise with the increase in diameter of the wound up ribbon 1, as the ribbon 1 is wound up on take up spool 6**. For sake of simplicity the used tape being wound on the spools is shown in the drawing as being partly in dotted lines and remainder in solid line.

Ribbon 1 is drawn out from supply spool 2 and is wound up on take up spool 6 through a path comprising ribbon outlet 11 and ribbon inlet 12 formed in the extremities of arms 10 of case 4, respectively.

Figure 2A:
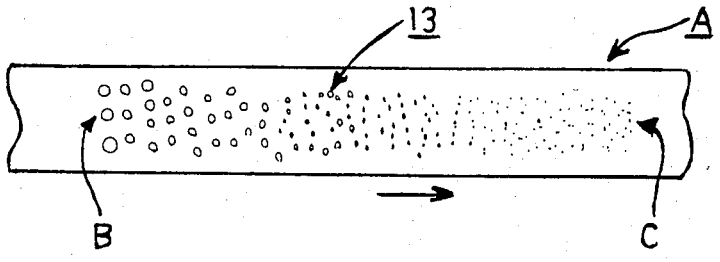
FIGS. 2A and 2B are front elevational views depicting two alternative configurations of the inside wall surface.
Figure 2B:
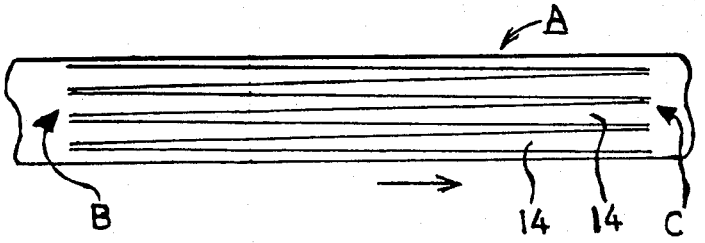

FIGS. 2A and 2B depict examples of compositions, shapes and configurations of the inside wall surface A of lower case 4 against which ribbon 1 is kept in constant contact during the time supply spool 2 is being used, namely from the time of being fully loaded to being completely exhausted.

In one embodiment, inside wall surface A, as shown in FIG. 2A, is manufactured in a manner to form dots 13. Dots 13 decrease gradually in size from a position B where ribbon 1 is wound fully (i.e. fully loaded) on supply spool 2 toward a position C where the ribbon 1 is in contact with the inside wall surface A when the ribbon 1 of supply spool 2 is exhausted (see FIG. 1).

Therefore, the area of contact between ribbon 1 and inside wall surface A, hence, the frictional resistance against the movement of ribbon 1, increases as the position of contact between ribbon 1 and inside wall surface A changes from position B to position C. Although the resilient force of torsion spring 3 that works on supply spool 2 gradually decreases as the diameter of the wound up ribbon 1 on supply spool 2 decreases, the reduction of resilient force of torsion spring 3 is compensated by the increase of frictional resistance. Consequently, the friction between ribbon 1 and inside wall surface A remains substantially constant regardless of the diameter of the wound up ribbon 1 on supply spool 2.

FIG. 2B depicts an alternative surface configuration for the inside wall surface A. In this embodiment, ribs 14 are used instead of dots 13 in FIG. 2A. Ribs 14 formed on inside wall surface A increase in width from position B toward position C, and perform the same function as the dots in FIG. 2A.

The inside wall surface A may assume other shapes, sizes, constructions and configurations, provided that inside wall surface A is capable of applying increasing frictional resistance to ribbon 1 as the position of contact between ribbon 1 and inside wall surface A changes from position B to position C. Where the ribbon contacts the inside wall surface, there is a rough surface. The term rough means one which provides a desired amount of frictional resistance sufficient to place an even predetermined amount of tension continuously on the ribbon during printing operation.

The operation will now be described with reference to FIG. 1. Drive roller 7 is rotated during printing operation to thereby rotate take up spool 6. Since torsion spring 8 engages and biases center stud 6*a* of take up spool 6, continually toward drive roller 7, the driving force of drive roller 7 is reliably transmitted to take up spool 6. As take up spool 6 is rotated, ribbon 1 is drawn out from supply spool 2, moved through ribbon outlet 11 and ribbon inlet 12 and taken up on taken up spool 6.

During the ribbon supplying and take up operation, supply spool 2 is biased continually in a clockwise direction by torsion spring 3. The center of supply spool 2 moves along the circumference of a circle having a radius corresponding to the distance between coiled part 3*b* (i.e. pin 6 as center) and free end 3*a* of torsion spring 3, as the diameter of wound up supply of ribbon 1 on spool 2 decreases, from a position illustrated by the continuous line toward a position illustrated by the broken line. As ribbon 1 is drawn out from supply spool 2, the position of contact between ribbon 1 and the inside wall surface A of lower case 4, changes as described hereinbefore. Concurrently, the diameter of the ribbon being wound up on spool 6 increases, and the center stud 6*a* of spool 6 moves rightward, as viewed in FIG. 1, along guide slot 9.

The foregoing is illustrative of the principles of the invention. Numerous extensions and modifications thereof would be apparent to the worker skilled in the art. All such extensions and modifications are to be considered to be within the spirit and scope of the invention.

What is claimed is:

1. A ribbon cartride comprising a case; a supply spool disposed within said case, for carrying a supply of ribbon, said ribbon having two edges and two surfaces; a take up spool disposed within said case, for winding up said ribbon as supplied by said supply spool; a spring member for biasing said supply spool so that one of said surfaces of said ribbon wound on said supply spool is pressed continually against an inside wall surface of said case;

the point of contact of said supply spool and said wall surface travelling along said wall surface as ribbon is removed from said supply spool; means to maintain substantially constant tension on said ribbon as it is unwound from said supply spool comprising a rough surface on the part of said inside wall surface which said supply spool traverses as ribbon is removed from said supply spool, the degree of roughness of said rough surface increasing at a substantially constant rate in the direction of movement of the contact point of said supply spool with said rough surface as the supply spool moves across the rough surface in response to ribbon being removed from said supply spool, the increase in ribbon tension due to said increase in frictional resistance counteracting a decrease in ribbon tension due to a decrease in biasing force supplied to the supply spool by said spring member.

2. The cartridge of claim 1, wherein said spring member comprises an intermediate part coiled around a pin fixed to said case; one end engaging said inside wall surface of said case; and another end engaging a central part of said supply spool, thereby to bias said supply spool so that said ribbon wound on said supply spool is pressed against said rough surface of said case.

3. The cartridge of claim 1, wherein said rough surface is formed so that the frictional resistance of said surface to said ribbon increases with decrease in diameter of said ribbon wound on said supply spool.

4. The cartridge of claim 3, wherein roughness of said rough surface varies gradually from one end toward another end of said rough surface.

5. The cartridge of claim 3, wherein said rough surface comprises a plurality of ribs each having an upper surface increasing in width from one end toward another end thereof.

6. The cartridge of claim 3, wherein said rough surface comprises a plurality of dots decreasing in number from one end toward another end thereof.

7. A ribbon cartridge comprising a case; a supply spool disposed within said case, for carrying a supply of ribbon; said ribbon having at least one flat surface; a take up spool disposed within said case, for winding up said ribbon as supplied by said supply spool; a spring member for biasing said supply spool so that said ribbon wound on said supply spool is pressed continually against an inside wall surface of a side wall of said case; said spring member having an intermediate part coiled around a pin fixed to said case, one end attached to said inside wall surface of said case, and another end rotatively supporting a central part of said supply spool; said spring member biasing said supply spool to press said surface of said ribbon wound on said supply spool against said inside wall surface of the side wall of said case, the position of contact between the surface of said ribbon wound on said supply spool and said inside wall surface changing as the diameter of the wound up ribbon on said supply spool decreases; means to maintain substantially constant tension on said ribbon including a rough surface on said inside wall surface engaging said ribbon, said rough surface increasing contact area between said surface of said ribbon wound on said supply spool and said inside wall surface as the diameter of the wound up ribbon on said supply spool decreases, so that a decrease in the biasing force of said spring member upon decreasing of the diameter of the wound up ribbon on said supply spool is compensated by the increasing area of contact between said surface of said ribbon wound on said supply spool and said inside wall surface.

8. The cartridge of claim 7, wherein said rough surface comprises a plurality of ribs each having an upper surface increasing in width from one end position where the ribbon wound fully on said supply spool is in contact with said inside wall surface, toward the other end position where the ribbon is in contact with the inside wall surface when the ribbon of the supply spool is almost exhausted.

9. The cartridge of claim 7, wherein said rough surface comprises a plurality of dots decreasing in size from one end position where the ribbon wound fully on said supply spool is in contact with the inside wall surface, toward the other end position where the ribbon is in contaxt with the inside wall surface when the ribbon of the supply spool is almost exhausted.

* * * * *